US006918795B2

(12) United States Patent
Xue

(10) Patent No.: US 6,918,795 B2
(45) Date of Patent: Jul. 19, 2005

(54) ELECTRICAL CONNECTOR WITH ANTI-MISMATING DEVICE

(75) Inventor: Yalei Xue, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/951,478

(22) Filed: Sep. 27, 2004

(65) Prior Publication Data

US 2005/0070168 A1 Mar. 31, 2005

(30) Foreign Application Priority Data

Sep. 26, 2003 (TW) ..... 92217369 U

(51) Int. Cl.[7] ..... H01R 24/00
(52) U.S. Cl. ..... 439/676
(58) Field of Search ..... 439/296, 344, 439/345, 374, 676, 677, 678, 680, 681

(56) References Cited

U.S. PATENT DOCUMENTS 6,257,935 B1 * 7/2001 Zhang et al. ..... 439/680
6,296,528 B1 10/2001 Roberts et al.
6,312,293 B1 * 11/2001 Wang ..... 439/677
6,319,070 B1 * 11/2001 Tan ..... 439/680
6,350,157 B1 2/2002 Mizusawa
6,354,884 B1 * 3/2002 Yeh et al. ..... 439/680
6,371,790 B1 * 4/2002 Huang ..... 439/378

* cited by examiner

*Primary Examiner*—Thanh-Tam Le
(74) *Attorney, Agent, or Firm*—Wei Te Chung

(57) ABSTRACT

An electrical connector (100) is provided for mating with a complementary plug and includes an insulative housing (10), a terminal module (20) having a number of conductive terminals (202) retained therein and an anti-mismating device (30) integrally formed with the housing. The housing includes a side wall (102) and a receiving cavity (106) for receiving the plug. The side wall defines a window (1021) communicating with the receiving cavity. Each terminal has a contacting portion extending into the receiving cavity of the housing. The anti-mismating device is seated inside of the window and includes a base portion (301) being movably received in the window, a stopper portion (302) extending inwardly from the base portion and into the receiving cavity, and a tapered guiding portion (303) in front of the stopper portion.

3 Claims, 3 Drawing Sheets

ELECTRICAL CONNECTOR WITH ANTI-MISMATING DEVICE

BACKGROUND OF THE INVENTION

1. Field of the Invention

The present invention relates to electrical connectors and more particularly, to an electrical connector having an anti-mismating device therein to prevent improper insertion of a smaller sized plug connector.

2. Description of the Related Art

RJ-11 and RJ-45 receptacles respectively engaging with RJ-11 and RJ-45 plugs are commonly used in network communications. RJ-45 receptacle and plug have larger dimensions than RJ-11 receptacle and plug. Therefore, an RJ-11 plug is inadvertently inserted into an RJ-45 receptacle, which may result in damage to the terminals of the RJ-45 receptacle.

U.S. Pat. No. 6,296,528 B1 issued to Roberts et al on Oct. 2, 2001 discloses a conventional modular jack. The modular jack comprises an insulative housing defining a plug-receiving cavity and a pair of anti-mismating devices formed in an upper portion of the plug-receiving cavity. Each anti-mismating device comprises an cantilevered arm extending forwardly from a rear wall of the housing. The cantilevered arm comprises a forwardly-positioned sliding surface and a stop surface formed on an inner side of the sliding surface at a free end thereof. The stop surface is provided for blocking an undersized plug being inserted. When a mating plug is inserted into the cavity, the leading edge of the mating plug contacts the more forwardly-positioned sliding surface before reaching the stop surface and rides along the sliding surface, which causes the sliding surface to move upwardly. The movement produces the upwardly movements of the anti-mismating member and the stop surface such that the stop surface is located out of a stop position, permitting full insertion of the mating plug into the cavity.

However, the Roberts housing needs to provide enough space to allow the anti-mismating device to be movable in the upper portion of receiving cavity, thereby increasing height of the housing. Thus the Roberts modular jack has a relative larger size.

Hence, an electrical connector with improved anti-mismating device is needed to overcome the foregoing shortcomings.

BRIEF SUMMARY OF THE INVENTION

An object of the present invention is to provide an electrical connector having an improved anti-mismating device therein for blocking insertion of smaller sized connectors.

In order to achieve the object set forth, An electrical connector is provided for mating with a mating plug and includes an insulative housing, a terminal module having a number of conductive terminals retained therein and an anti-mismating device integrally formed with the housing. The housing includes a side wall and a receiving cavity for receiving the plug. The side wall defines a window communicating with the receiving cavity. Each terminal has a contacting portion extending into the receiving cavity of the housing. The anti-mismating device is seated inside of the window and includes a base portion being movable in the window, a stopper portion extending inwardly from the base portion and into the receiving cavity, and a tapered guiding portion in front of the stopper portion. When the mating plug is inserted into the receiving cavity, the guiding portion is engaged and thus the stopper portion is deflected outwardly and out of the mating plug insertion direction thereby allowing the mating plug insertion into the electrical connector, and when the undersized plug is inserted into the receiving cavity, the stopper portion is struck thereby preventing insertion thereof.

Other objects, advantages and novel features of the invention will become more apparent from the following detailed description when taken in conjunction with the accompanying drawings.

DETAILED DESCRIPTION OF THE INVENTION

Figure 1:
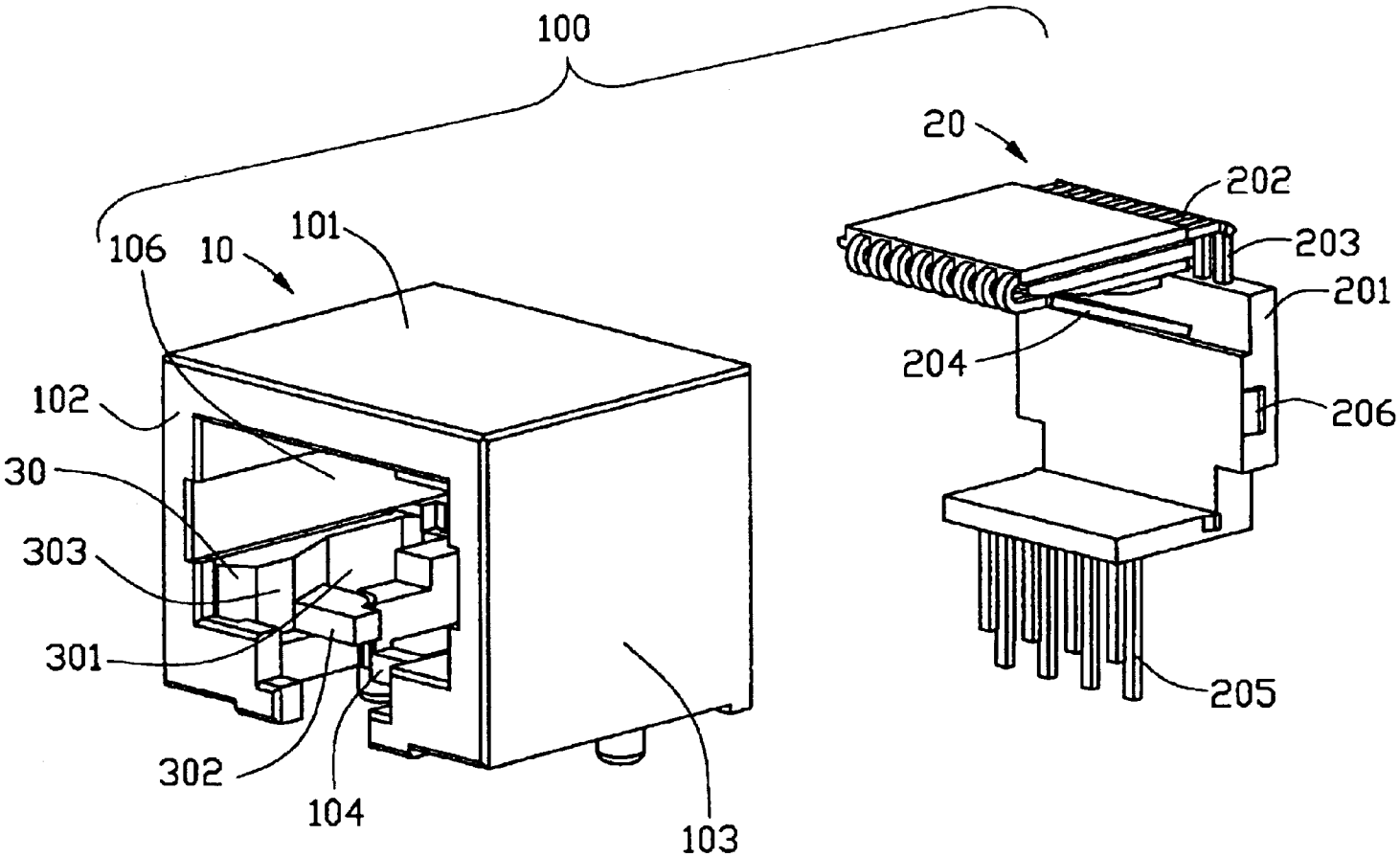
FIG. 1 is an explode view of an electrical connector according to the present invention.

Referring to FIG. 1, an electrical connector 100 in accordance with the present invention is adapted for receiving a mating plug such as an RJ-45 type plug (not shown). The electrical connector includes an insulative housing 10, a terminal module 20 and an anti-mismating device 30 integrally formed with the housing 10.

Figure 2:
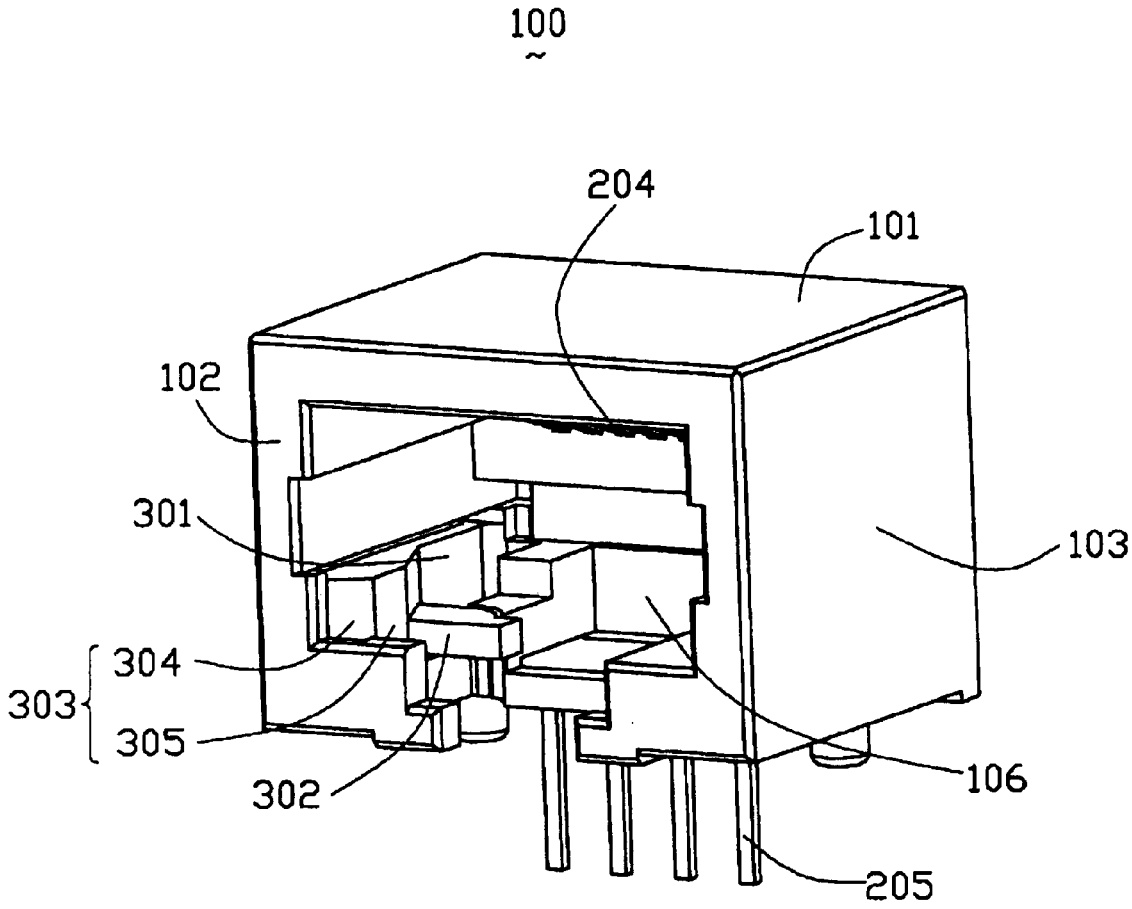
FIG. 2 is an assembled view of FIG. 1.
Figure 3:
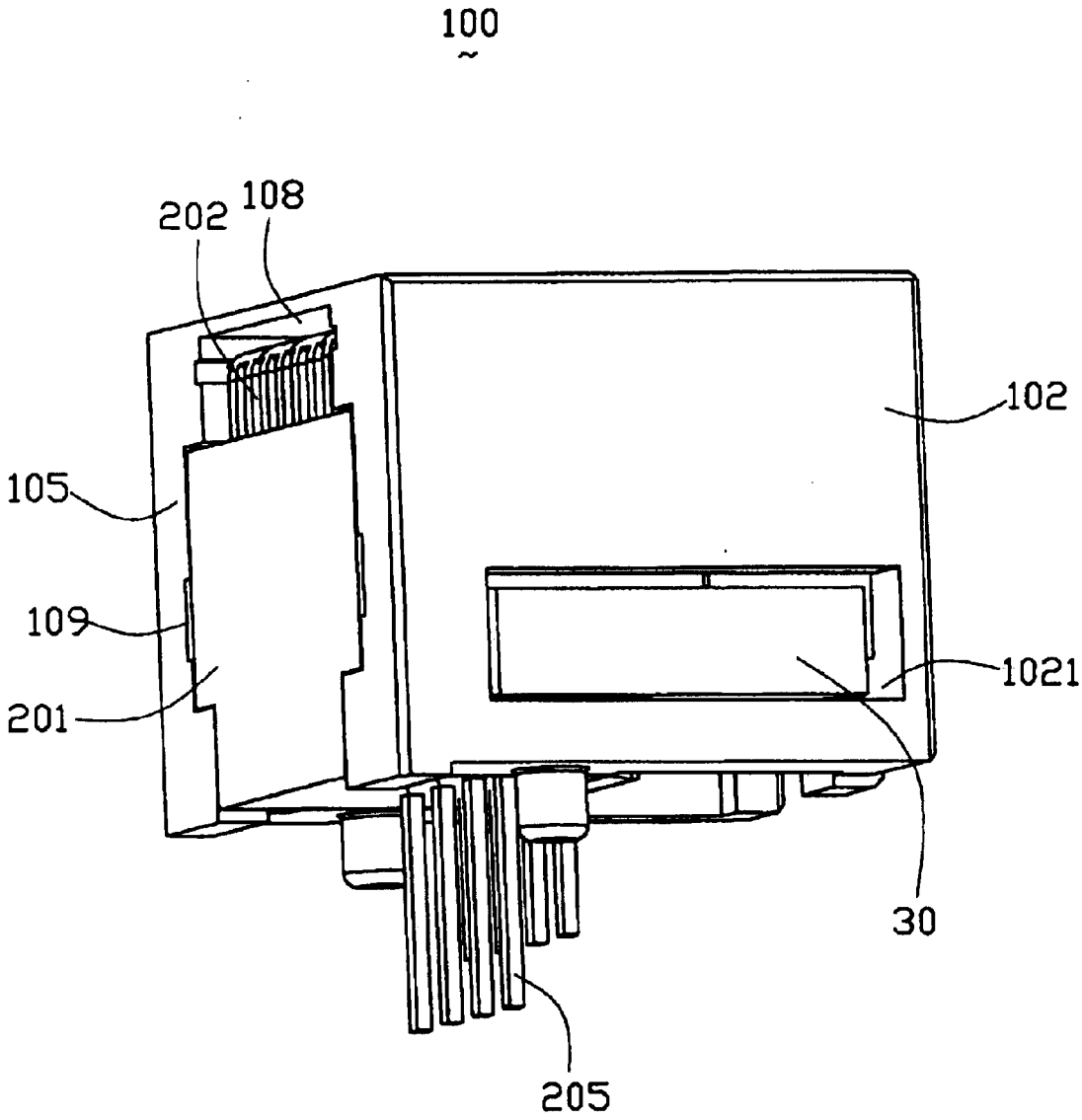
FIG. 3 is another assembled view of FIG. 1.

Referring to FIGS. 1, 2 and 3, the insulative housing 10 is substantially rectangle configuration and has a front mating face (not labeled) providing a receiving cavity 106 extending thereinto. The housing 10 comprises an upper wall 101, a left side wall 102, a right side wall 103, a bottom wall 104, a rear wall 105. The anti-mismating device 30 is unitarily molded with one of the side walls. In the preferred embodiment, the anti-mismating is arranged on the left side wall 102. A window 1021 is defined in a lower portion of the left side wall 102 and communicates with the receiving cavity 106. The rear wall 105 defines an opening 108 therein. A pair of grooves 109 are defined on opposite sides of the opening 108.

As best shown in FIG. 1, the terminal module 20 includes an insulator 201 and a plurality of terminals 202 insert molded with the insulator 201. Each terminal 202 includes a body portion 203, a contacting portion 204 extending downwardly and rearwardly from one side of the body portion 203, and a soldering portion 205 extending downwardly from the other side of the body portion 203. The insulator 201 has a pair of protrusions 206 on opposite sides thereof for engaging with corresponding grooves 109 of the housing 10.

Referring to FIG. 2 in conjunction with FIG. 1, the anti-mismating device 30 is integrally formed with the housing 10 and is arranged inside of the window 1021 (shown in FIG. 3) of the left side wall 102. The anti-mismating device 30 comprises a base portion 301 having a rear end connected to the sidewall 102, a stopper portion 302 extending inwardly and horizontally from the base portion 301, and a tapered guiding portion 303 arranged in front of the stopper portion 302. The base portion 301 is substantially cantilevered and is movable in the window 1021 in a direction perpendicular to an insertion direction of the mating plug. The guiding portion 303 extends inwardly from a front portion of the base portion 301 and exposes in the receiving cavity 106. The guiding portion 303 includes a front inclined surface 304 and a rear inclined surface 305 immediately behind the front inclined surface 304. The rear inclined surface 305 has a relatively smaller gradient than that of the first inclined surface 304 so as to provide a relatively smaller resistance to allow insertion of the mating plug into the receiving cavity 106 of the housing 10.

Referring to FIGS. 1–3, in assembly, the terminal module 20 is installed in the housing 10 in a front-to-rear direction. The contacting portion 204 of the terminals 202 expose in the receiving cavity 106 of the housing 10. The protrusions 206 of the insulator 201 are securely received in the corresponding grooves 109. The soldering portions 205 of the terminals 202 extend out of the bottom wall 104 for soldering to the printed circuit board (not shown).

Operation of the electrical connector 100 of the present invention will now be described. The RJ-45 plug (not shown) is adequate to snuggly fit with the receiving cavity 106 of the electrical connector 100 and moves along the front and rear inclined surface 304, 305 of the guiding portion 303. As such, the guiding portion 303 of the anti-mismating device 30 is engaged by the insertion end of the RJ-45 plug and are thus deflected outwardly as the RJ-45 plug is inserted into the receiving cavity 106. As the RJ-45 plug is further insert into the receiving cavity 106, the stopper portion 302 is deflected outwardly and out of the RJ-45 plug insertion direction such that the stopper portion 302 does not interfere with insertion of the RJ-45 plug. In this way, the plug can be successfully inserted into the electrical connector 100 whereby contacts of the RJ-45 plug can be electrically mated with the contacting portions 204 of the terminals 202.

However, when an RJ-11 plug (not shown) is erroneously inserted through the receiving cavity 101, since the RJ-11 plug has a smaller width than the RJ-45 plug, the RJ-11 plug does not entirely fill the receiving cavity 106. As such, the inserted RJ-11 plug can not engage and push the guiding portion 303 aside, and the insertion of a latch of the RJ-11 plug into the receiving cavity 106 strikes the stopper portion 302 prior to engagement with the contacting portions 204 of the terminals 202. Thus the RJ-11 plug is blocked from full insertion by the stopper portion 302 of anti-mismating device 30 and a reliable anti-mismating is obtained.

It should be noted that, the right side wall 103 also can define a window 1021, and the anti-mismating device 30 can be formed in the window 1021 of the right side wall 103. The electrical connector 100 also can arranges a pair of anti-mismating devices 30 on the left side wall 102 and right side wall respectively.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mating with a complementary plug comprising:

an insulative housing having a front mating face providing a receiving cavity for receiving the plug, a window being defined in a lower portion of a side wall, and an opening being defined in a rear wall, wherein the window and the opening communicating with the receiving cavity;

an insulative anti-mismating device integrally formed with the housing and arranged inside the window, the anti-mismating device including a base portion being movably received in the window, a stopper portion being extended inwardly from the base portion and into the receiving cavity, and a tapered guiding portion arranged in a front of the stopper portion; and a terminal module secured conductive terminal therein and attached to the opening of the rear wall;

wherein the terminal module includes a top plate, a bottom plate parallel to the top plate, and an intermediate plate therebetween, wherein the top plate, the bottom plate and the intermediate plate commonly defining a U-shaped cross-section and a space in which contacting portions of the conductive terminals are disposed;

wherein the opening of the rear wall having grooves and the intermediate plate having protrusions each securely received in a corresponding groove;

wherein the guiding portion extended inwardly from a front portion of the base portion and exposed in the receiving cavity;

wherein the guiding portion includes a front inclined surface and a rear inclined surface immediately behind to the front inclined surface; and wherein the base portion is substantially cantilevered and has one end integrally connected to the side wall.

2. The electrical connector according to claim 1, wherein the stopper portion is moveable in response to an insertion of the complementary plug.

3. The electrical connector according to claim 1, wherein the anti-mismating device moves in a direction perpendicular to an insertion direction of the complementary plug.

* * * * *